US009532641B2

(12) United States Patent
Kim

(10) Patent No.: US 9,532,641 B2
(45) Date of Patent: Jan. 3, 2017

(54) L-SHAPED TOOTHBRUSH

(71) Applicant: Il Tae Kim, Chungcheongnam-do (KR)

(72) Inventor: Il Tae Kim, Chungcheongnam-do (KR)

( * ) Notice: Subject to any disclaimer, the term of this patent is extended or adjusted under 35 U.S.C. 154(b) by 0 days.

(21) Appl. No.: 15/081,630

(22) Filed: Mar. 25, 2016

(65) Prior Publication Data

US 2016/0345718 A1 Dec. 1, 2016

(30) Foreign Application Priority Data

May 26, 2015 (KR) ..... 20-2015-0003327 U

(51) Int. Cl.

| | |
|---|---|
| ***A46B 5/02*** | (2006.01) |
| ***A46B 9/04*** | (2006.01) |
| ***A46B 5/00*** | (2006.01) |
| ***A46B 9/02*** | (2006.01) |

(52) U.S. Cl.

CPC ..... *A46B 5/021* (2013.01); *A46B 5/0012* (2013.01); *A46B 9/028* (2013.01); *A46B 9/04* (2013.01); *A46B 9/045* (2013.01); *A46B 2200/1066* (2013.01)

(58) Field of Classification Search

CPC ..... A46B 9/028; A46B 9/04; A46B 9/045; A46B 5/0012

See application file for complete search history.

(56) References Cited

U.S. PATENT DOCUMENTS

| | | | | | |
|---|---|---|---|---|---|
| 1,421,199 | A * | 6/1922 | Field | A46B 9/045 | 15/167.2 |
| 1,513,104 | A * | 10/1924 | Gracey | A46B 9/026 | 15/167.1 |
| 4,457,039 | A * | 7/1984 | Massari | A46B 5/02 | 15/143.1 |
| 4,517,701 | A * | 5/1985 | Stanford, Jr. | A46B 5/02 | 15/106 |
| 5,544,383 | A * | 8/1996 | Gamble | A46B 9/04 | 15/106 |
| 5,787,540 | A * | 8/1998 | Hirschmann | A46B 5/0075 | 15/167.1 |
| 6,018,838 | A * | 2/2000 | Nowack | A46B 5/02 | 15/143.1 |
| 6,308,365 | B1 * | 10/2001 | Huang | A46B 5/02 | 15/106 |
| D517,814 | S * | 3/2006 | Cade, Jr. | D4/110 | |

FOREIGN PATENT DOCUMENTS

| | | | |
|---|---|---|---|
| FR | 2 836 346 | * | 8/2003 |
| JP | 2002-051837 | A | 2/2002 |
| KR | 10-1986-0000481 | B1 | 8/1993 |

* cited by examiner

*Primary Examiner* — Randall Chin
(74) *Attorney, Agent, or Firm* — Korus Patent, LLC; Seong Il Jeong

(57) ABSTRACT

An L-shaped toothbrush comprises a head having a top surface and a bottom surface, a horizontal length of the head being larger than a vertical length of the head, a lower brush formed in a direction perpendicular to the bottom surface of the head, a handle connected to a side surface of a middle portion of the head, bent in an L shape, and extending from the head, the handle integrally formed with the bead, and an upper brush formed on the top surface of the head.

1 Claim, 4 Drawing Sheets

L-SHAPED TOOTHBRUSH

CROSS-REFERENCE TO RELATED APPLICATIONS

This patent application claims priority under 35 U.S.C. §119 to Korean Utility Model Application No. 20-2015-0003327, filed on May 26, 2015, in the Korean Intellectual Property Office, the disclosure of which is incorporated by reference herein M its entirety.

TECHNICAL FIELD

Embodiments of the present disclosure concern toothbrushes, and more specifically, toothbrushes bent substantially in an L shape.

DISCUSSION OF RELATED ART

The toothbrush is an oral hygiene instrument used to clean the teeth and gums that consists of a head of tightly clustered bristles mounted on a handle, which facilitates the cleansing of hard-to-reach areas of the mouth.

Various types of toothbrushes have been introduced and developed thus far, but they fail to do cleaning of the teeth positioned deep inside the mouth and are mostly uncomfortable to handle. Further, such conventional toothbrushes do not live up to users who desire to thoroughly clean up the teeth after tooth extraction.

SUMMARY

According to an embodiment of the present disclosure, there is provided a toothbrush that is overall shaped as the letter L. The L-shaped toothbrush comprises a head haring a top surface and a bottom surface, a horizontal length of the head being larger than a vertical length of the head, a lower brush formed in a direction perpendicular to the bottom surface of the head, and a handle connected to a side surface of a middle portion of the head, bent in an L shape, and extending from the head, the handle integrally formed with the head, an upper brush formed on the top surface of the head. The L-shaped toothbrush may further comprise a fastener provided in a middle portion of the head to fasten the lower brush and the upper brush in a direction perpendicular to the lower brush and the upper brush.

The lower brush and the upper brush may be integrally formed with each other or may be formed as a single body. The lower brush and the upper brush may pass through the head. The length of the lower brush and the upper brush increases away from the handle.

BRIEF DESCRIPTION OF THE DRAWINGS

A more complete appreciation of the present disclosure and many of the attendant aspects thereof will be readily obtained as the same becomes better understood by reference to the following detailed description when considered in connection with the accompanying drawings, wherein.

DETAILED DESCRIPTION OF EXEMPLARY EMBODIMENTS

Hereinafter, exemplary embodiments of the inventive concept will he described in detail with reference to the accompanying drawings. The inventive concept, however, may be modified in various different ways, and should not be construed as limited to the embodiments set forth herein. As used herein, the singular forms "a," "an," and "the" are intended to include the plural forms as well, unless the context clearly indicates otherwise. It will be understood that when an element or layer is referred to as being "on," "connected to," "coupled to," or "adjacent to" another element or layer, it can be directly on, connected, coupled, or adjacent to the other element or layer, or intervening elements or layers may be present.

Figure 1:
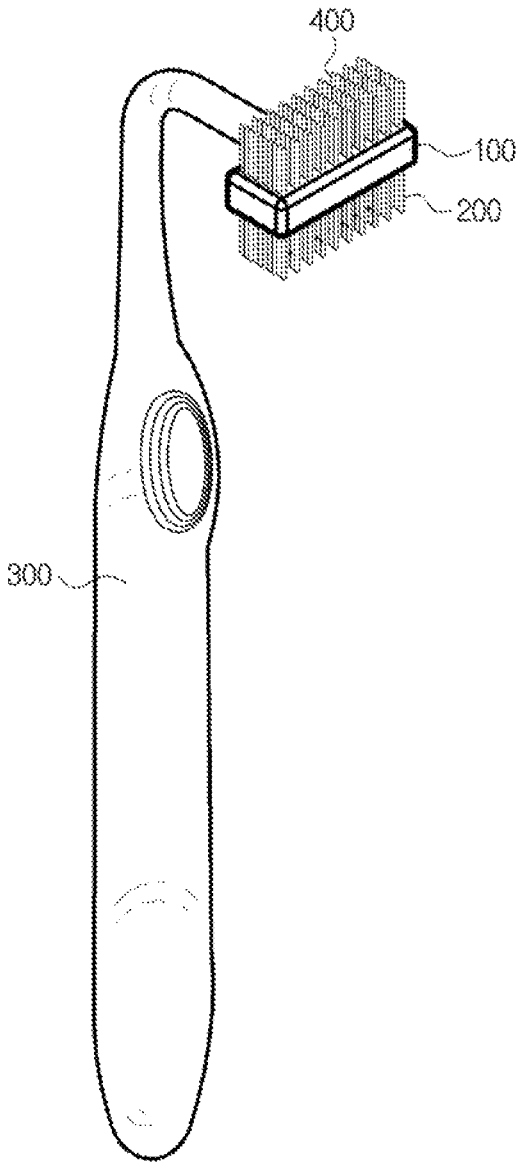
FIG. 1 is a perspective view illustrating an L-shaped toothbrush according to embodiment of the present disclosure.
Figure 2:
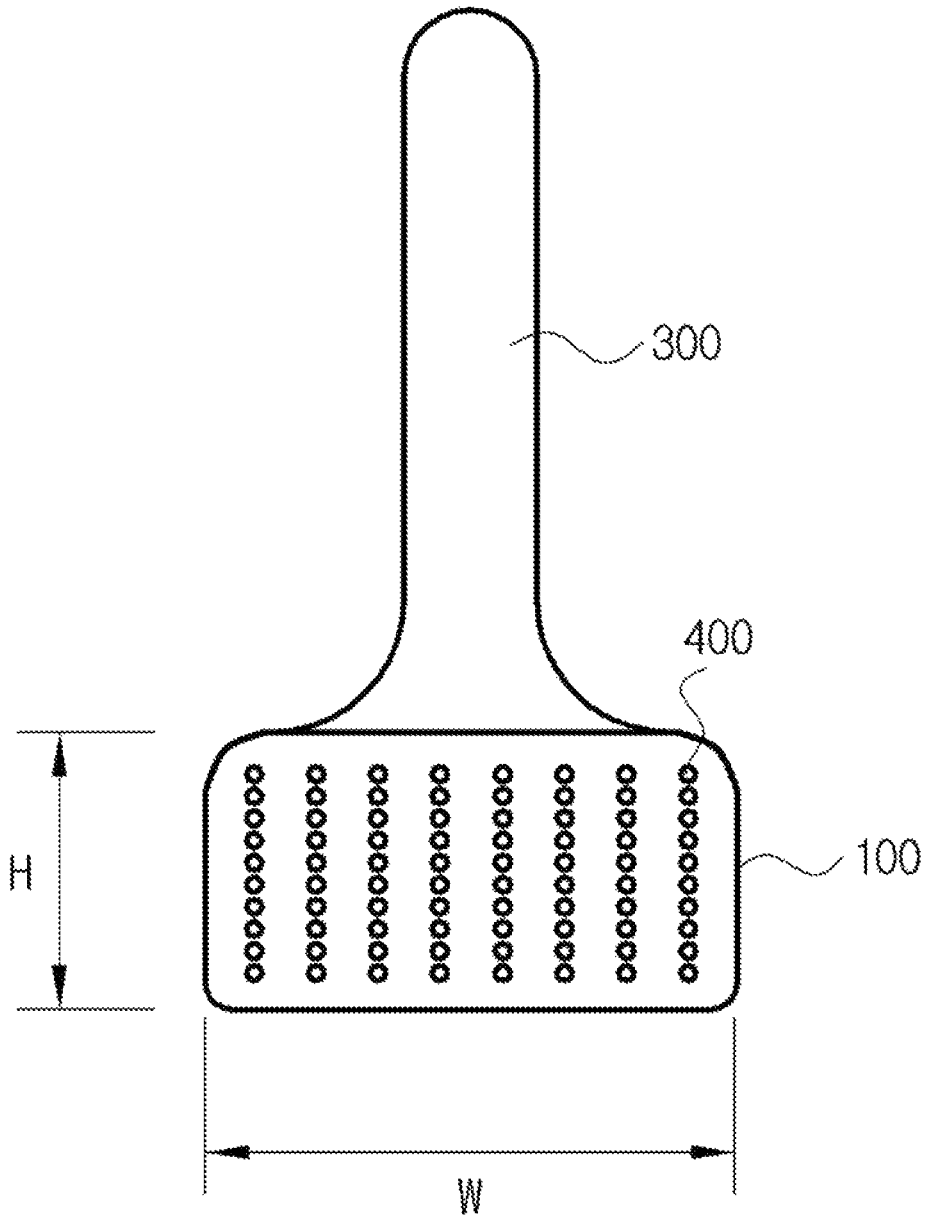
FIG. 2 is a top view illustrating an upper portion of an L-shaped toothbrush according to an embodiment of the present disclosure.
Figure 3:
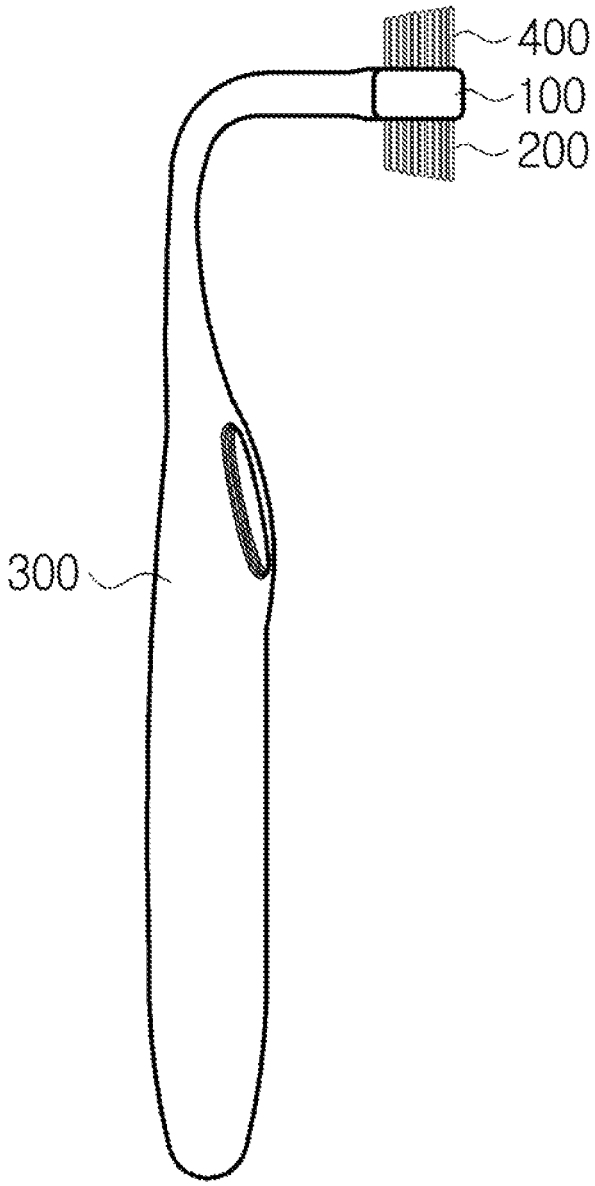
FIG. 3 is a cross-sectional view illustrating an L-shaped toothbrush, which is taken in a longitudinal direction thereof, according to an embodiment of the present disclosure.
Figure 4:
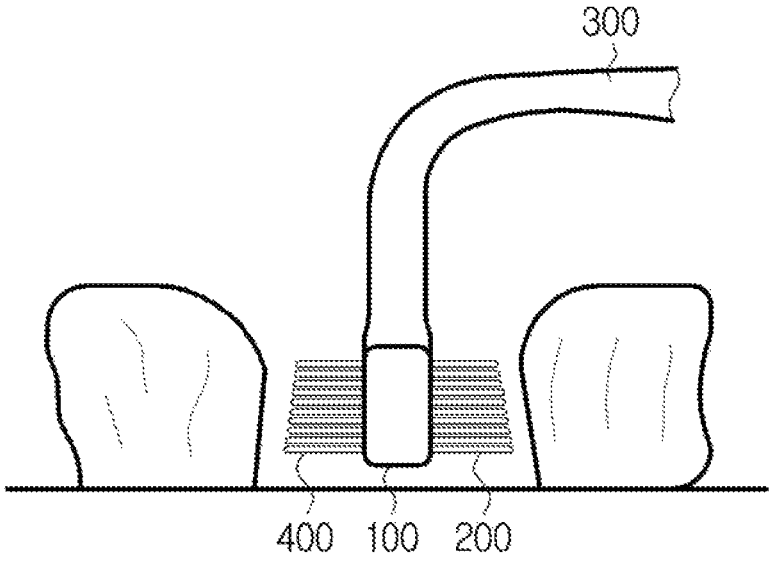
FIG. 4 is a view illustrating an example of using an L-shaped toothbrush according to an embodiment of the present disclosure.

FIG. 1 is a perspective view illustrating an L-shaped toothbrush according to an embodiment of the present disclosure. FIG. 2 is a top vim illustrating an upper portion of an L-shaped toothbrush according to an embodiment of the present disclosure. FIG. 3 is a cross-sectional view illustrating an L-shaped toothbrush, which is taken in a longitudinal direction thereof, according to an embodiment of the present disclosure. FIG. 4 is a view illustrating an example of using an L-shaped toothbrush according to art embodiment of the present disclosure.

Referring to FIGS. 1 and 2, the L-shaped toothbrush includes a head 100, a lower brush 200, a handle 300, and an upper brush 400. The head 100 includes a top surface and a bottom surface. The top surface and bottom surface of the head 100 may be shaped as a rounded rectangle whose horizontal side is longer than the vertical side thereof. As the top and bottom of the head 100 are shaped as a rounded rectangle, the user may be avoided from damaged when using the L-shaped toothbrush in his mouth. However, the top and bottom surface of the head 100 is not limited to the rounded rectangular shape and may have other various shapes including polygons. When the top and bottom of the head 100 is shaped as a polygon, the corners of the polygon ma be rounded to prevent the user from being injured upon use of the brush.

The length of the horizontal side is denoted as W, and the length of the vertical side is denoted as H. The horizontal length W is larger than the vertical length H of the head 100 as shown in FIG. 2. Upon using the L-shaped toothbrush, the vertical side of the head 100 may be positioned at a side of a tooth or between two adjacent teeth (e.g., molars) in the same direction as that of the tooth or to face a side of the tooth. The horizontal length W may be slightly larger than the width of a tooth in such an extent that the left and right sides of the head 100 do not touch other portions in the user's mouth to prevent the user from feeling uncomfortable.

As shown in FIGS. 1 to 4, the lower brush 200 may be vertically formed on the bottom surface of the head 100. The lower brush 200 may directly contact the user's teeth. The lower brush 200 may be formed of bristles of a known toothbrush. The lower brush 200 may rub against a tooth to remove various din or plaque on the tooth.

As shown in FIG. 3, the length of bristles of the lower brush 200 may increase away from the handle 300 for easier cleaning of side portions of teeth. Generally, molars which are positioned deep inside the mouth have at narrowing width from the crown to the gums and their sides are inclined. The bristles of the lower brush 200 have lengths corresponding to such structure of the teeth. For example, using the L-shaped toothbrush, an tippet bristle of the lower brush 200, which is relatively shorter, is positioned at an upper side portion of the teeth while a lower bristle of the lower brush 200, which is relatively longer, is positioned at a lower side portion of the teeth.

Referring to FIG. 3, the handle 300 is connected to a central portion of a side of the head 100. The handle 300 is bent in an L shape and extends in a direction perpendicular to the top or bottom of the head 100. The angle between the top or bottom of the head 100 and the handle 300 may be about 80 degrees to about 100 degrees, preferably, 90 degrees. As the angle between the top or bottom of the head 100 and the handle 300 approaches 90 degrees, a portion of the teeth inside the mouth, which is otherwise difficult to clean up, may be easily brushed up without significant effort.

The head 100 and the handle 300 may be integrally formed together or formed as a single body. The head 100 and the handle 300 may be formed of the same material, e.g., an elastic material, including but not limited to, plastic. Silicone may be formed, attached, or coated on the handle 300. The handle 300 is a portion that the user holds with his hand, and thus, the handle 300 may have an ergonomic design or rounded or other various shapes in order for the user to gab in an easy and comfortable manner.

The upper brush 400 is formed on the top surface of the head 100. The upper brush 400 may be provided to facilitate to clean up the teeth positioned next to an extracted tooth.

Referring to FIG. 4, the L-shaped toothbrush is positioned between two opposite teeth after the tooth between the two teeth has been pulled out so that the respective sides of the two teeth can be easily brushed by the upper brush 400 and the lower brush 200. The distance between an end of the lower brush 200 and an end of the upper brush 400 may be substantially the same as the width of the extracted tooth so that the head 100 of the L-shaped toothbrush may be positioned between the two opposite teeth. Alternatively, the distance between an end of the lower brush 200 and an end of the upper brush 400 may be larger than the width of the extracted tooth, and in this case, one of the lower brush 200 and the upper brush 400 may be inserted in a diagonal direction to the space between the two opposite teeth to brush the side of one of the two teeth, and the other may be inserted to brush the side of the other of the two teeth. As such the two teeth may be alternately brushed up.

The lower brush 200 and the upper brush 400 may be formed of nylon™ or polybutylene terephthalate (PBT) or other known materials used to form bristles of a toothbrush. The bristles of the lower brush 200 and the upper brush 400 may be famed of a material that is durable, soft, or elastic, easy to remove dirt on the teeth, may provide a frictional force, and is easily dried to prevent growth of germs.

As shown in FIGS. 3 and 4, the upper brush 400 may have substantially the same shape as the lower brush 200. For example, the length of bristles of the lower brush 200 may increase away from the handle 300 for easier cleaning of side portions of teeth. For example, the bristles of the upper brush 400 or the lower brush 200 may be similar in shape to the side of a tooth.

The differences in length of the bristles of the lower brush 200 or the upper brush 400 may vary depending on the shape of the user.

The lower brush 200 and the upper brush 400 may be integrally formed with each other. For example, the bristles of the lower brush 200 may pass through the head 100 to form their respective corresponding bristles in the upper brush 400. The lower brush 200 and the upper brush 400 may be fixed or fastened by various methods. In an example method, a fastener slidable in a direction perpendicular to the lower brush 200 and the upper brush 400 may be provided in a middle portion of the head 100 so that the lower and upper brushes 200 and 400 are fastened when the fastener is inserted and released when the fastener is removed.

In another example method, holes may be punctured in the head 100 in a shape bent from the top of the head 100 to the bottom, and the bristles nary be implanted in the holes.

According to embodiments of the present disclosure, the handle is bent in an L shape, allowing for thorough cleaning of portions rearward the molars and side portions of teeth.

The length of the lower brush differs fitting the shape of the side of the teeth, allowing the side of the teeth to be brushed more easily.

Further, the lower brush and the upper brush are formed to be oriented in opposite directions, allowing for easier cleaning of the teeth around the pulled-out tooth.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. An L-shaped toothbrush, comprising:

a head having a top surface and a bottom surface, a horizontal length of the head being larger than a vertical length of the head;

a lower brush formed on the bottom surface of the head in a direction perpendicular to the bottom surface of the head;

a handle connected to a middle portion of a longer horizontal side of the head such that a longitudinal axis of the handle is parallel to a vertical axis of the head perpendicular to the top surface and the bottom surface, the handle being bent in an L shape, extending from the head, and being integrally formed with the head;

an upper brush formed on the top surface of the head in a direction perpendicular to the top surface of the head; and a fastener provided in a middle portion of the head to fasten the lower brush and the upper brush, the fastener being slidable in a direction perpendicular to the lower brush and the upper brush, wherein the lower brush and the upper brush are integrally formed with each other and passing through the head, and wherein the length of the lower brush and the upper brush increases away from the handle.

* * * * *